US008783549B2

(12) United States Patent
Jo

(10) Patent No.: US 8,783,549 B2
(45) Date of Patent: Jul. 22, 2014

(54) PACKING BOX

(71) Applicant: Samsung Electronics Co., Ltd., Gyeonggi-do (KR)

(72) Inventor: Kyoung-Hwan Jo, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 13/672,030

(22) Filed: Nov. 8, 2012

(65) Prior Publication Data

US 2013/0112741 A1 May 9, 2013

(30) Foreign Application Priority Data

Nov. 9, 2011 (KR) ..... 10-2011-0116210

(51) Int. Cl.
*B65D 5/24* (2006.01)
*B65D 5/36* (2006.01)

(52) U.S. Cl.
USPC ..... 229/117.08; 229/131.1; 229/162.3; 229/186

(58) Field of Classification Search
USPC ..... 229/117.07, 117.08, 131.1, 162.3, 186, 229/190; 206/736, 772, 773
See application file for complete search history.

(56) References Cited

U.S. PATENT DOCUMENTS

| | | | | | |
|---|---|---|---|---|---|
| 317,795 | A | * | 5/1885 | Jaeger | 229/117.07 |
| 1,132,877 | A | * | 3/1915 | Petterson | 229/117.08 |
| 1,228,714 | A | * | 6/1917 | Stortz | 206/756 |
| 1,824,927 | A | * | 9/1931 | Powell | 229/150 |
| 1,926,366 | A | * | 9/1933 | Bergstein | 229/186 |
| 2,285,991 | A | * | 6/1942 | Lester | 206/773 |
| 2,311,137 | A | * | 2/1943 | Sunderhauf et al. | 229/122.32 |
| 2,672,274 | A | * | 3/1954 | Crane | 229/159 |
| 3,937,393 | A | | 2/1976 | Nerenberg | |
| 4,416,377 | A | | 11/1983 | Swanberg | |
| 4,957,237 | A | * | 9/1990 | Madonna et al. | 229/120 |

FOREIGN PATENT DOCUMENTS

| | | | |
|---|---|---|---|
| DE | 19954324 | A1 | 5/2001 |
| EP | 0560223 | A1 | 9/1993 |
| GB | 823967 | A | 11/1959 |
| GB | 988360 | A | 4/1965 |
| JP | 10-139033 | A | 5/1998 |
| JP | 2010-047294 | A | 3/2010 |
| KR | 10-2002-0063473 | A | 8/2002 |
| KR | 20-0397983 | Y1 | 10/2005 |
| KR | 20-2010-0004922 | U | 5/2010 |
| KR | 20-2010-0005591 | U | 6/2010 |
| NL | 1023513 | C2 | 11/2004 |

* cited by examiner

*Primary Examiner* — Gary Elkins
(74) *Attorney, Agent, or Firm* — Cha & Reiter, LLC

(57) ABSTRACT

A packing box and method of forming a packing box provides a bottom plate, a pair of first side plates which upon final assembly are bent with respect to the bottom plate so as to face each other, a pair of second side plates which upon final assembly are bent with respect to the bottom plate so as to facing each other, and a pair of flaps at both sides of each of the first side plates which upon final assembly are bent with respect to the first side plate. Each of the flaps includes a first flap portion and a second flap portion, and before final assembly, the first flap portion is connected to a first side plate and the second flap portion is connected to the first flap portion, bent with respect to the first flap portion and affixed to one of the second side plates.

15 Claims, 4 Drawing Sheets

PACKING BOX

CLAIM OF PRIORITY

This application claims priority under 35 U.S.C. §119(a) to a Korean Patent Application filed in the Korean Intellectual Property Office on Nov. 9, 2011 and assigned Serial No. 10-2011-0116210, the contents of which are incorporated herein by reference in its entirety.

BACKGROUND OF THE INVENTION

1. Field of the Invention

The present invention relates to packaging a product such as accessories, an electronic device, a computer part, etc. and more particularly, to a packing box fabricated by bending a packing material which has been cut.

2. Description of the Related Art

In general, electronic devices or computer parts are packaged in various types of packing means to prevent breakage or damage during shipping. A packing means is typically made by machining and bending a lightweight, easy-to-handle sheet of paper product, such as a corrugated cardboard, into a hexahedron. A paper packing box is typically formed by printing a specific phrase or product design on a paper base board, cutting and machining the paper base board, and then bending the paper base board into a hexahedron shape so as form an interior space useful to contain items. More recently, a packing base board may also be formed of a synthetic resin as well as a paper product.

To keep the packing box in the form of a hexahedron shape once folded, edges of a cut base board should be affixed to each other. For this purpose, the edges of the base board may be affixed in a folded fashion or in a glued fashion.

An example of a packing box with glued edges is disclosed in Korea Utility Model Publication No. 2010-5591 (published on Jun. 3, 2010) and an example of a packing box with edges affixed in a folded fashion is disclosed in Korea Utility Model Registration No. 397,983 (registered on Oct. 4, 2005) and Korea Patent Application Publication No. 2002-63473 (published on Aug. 3, 2002).

Since the cost for manufacturing and assembling a packing box is added to the price of a product contained therein, there is a pressing need for reducing fabrication cost including material cost.

Additionally, in the case of a packing box with edges affixed by an adhesive, if a packing box supplier is different from a packing box user, a high distribution cost is suffered. That is, if the packing box is supplied in the form of a hexahedron, as compared to its pre-formed flat shape, it is bulky, resulting in a high cost for shipping and storage. Although the packing box can be supplied, not in the form of a hexahedron, this will require that the box user bend and glue the packing box on the spot, which decreases the user's productivity. Thus, it is difficult to reduce fabrication costs for a packing box which has edges affixed by an adhesive.

In contrast, a packing box with edges that are affixed through folding also can cause much higher cost for shipping and storage if it is supplied already formed into a hexahedron shape. However, a packing box user can easily finish such a packing box on the spot because the packing box does not require gluing. Therefore, the packing box may be supplied, half-finished in the state of a cut and machined base board, which will reduce the cost of shipping and storage. Despite this advantage, in most cases, such folded-type packing boxes are finished by manually folding cut and machined base boards into a hexahedron shape. As a consequence, productivity is still adversely affected.

SUMMARY OF THE INVENTION

The present invention provides a packing box which reduces logistics cost involved in shipping and storage.

In accordance with some embodiments of the present invention a packing box with a simplified structure is provided for facilitating fabrication.

In accordance with some embodiments of the present invention a packing box is provided that can be kept flat in a pre-finished state so that it can be readily shaped into a hexahedron when needed.

In accordance with some embodiments of the present invention a packing box is provided which can be kept flat in the process of bending and finishing a machined base board and thus is suitable for automation.

In accordance with an embodiment of the present invention, there is provided a packing box in which a bottom plate is provided, a pair of first side plates are arranged so as to extend in a substantially co-planar manner from opposed edges of the bottom plate, and adapted to be bent with respect to the bottom plate, so as to face each other upon final assembly of the packing box into a box shape; a pair of second side plates are arranged so as to extend in a substantially co-planar manner from opposed edges of the bottom plate, and adapted to be bent with respect to the bottom plate, so as to face each other upon final assembly of the packing box into a box shape; and a pair of flaps are provided at both sides of each of the first side plates, arranged so as to extend in a substantially co-planar manner from the first side plates, and adapted to be bent with respect to the first side plate upon final assembly of the packing box into a box shape.

Bending lines between the first flap portions and the second flap portions may be inclined at 45 degrees with respect to bending lines between the first side plates and the first flap portions.

According further embodiments of the present invention, a method for forming a packing box comprises initially providing a substantially flat bottom plate; providing a pair of first side plates arranged so as to extend in a substantially co-planar manner from opposed edges of the bottom plate, and adapted to be bent with respect to the bottom plate, so as to face each other upon final assembly of the packing box into a box shape; providing a pair of second side plates arranged so as to extend in a substantially co-planar manner from opposed edges of the bottom plate, and adapted to be bent with respect to the bottom plate, so as to face each other upon final assembly of the packing box into a box shape; and providing a pair of flaps at both sides of each of the first side plates, arranged so as to extend in a substantially co-planar manner from the first side plates, and adapted to be bent with respect to the first side plate upon final assembly of the packing box into a box shape, each of the flaps including a first flap portion and a second flap portion. Next, connecting the first flap portion to a first side plate and connecting the second flap portion to the first flap portion. Finally, bending the second flap portion with respect to the first flap portion, and affixing the bent second flap portion to one of the second side plates, where the first flap portion, the first side plate and the second flap portion after being affixed to one of the second side plates, are all substantially co-planar before being bent upon final assembly of the packing box into a box shape.

Thus, the method and apparatus of the present invention provides the user a way to have a packing box that can be kept flat in a pre-finished state, thereby reducing logistics cost involved in shipping and storage, and which packing box can be quickly and easily shaped when needed into a hexahedron without use of adhesives.

BRIEF DESCRIPTION OF THE DRAWINGS

The above features and advantages of embodiments of the present invention will be more apparent from the following detailed description taken in conjunction with the accompanying drawings, in which.

Throughout the drawings, the same drawing reference numerals will be understood to refer to the same elements, features and structures.

DETAILED DESCRIPTION OF EMBODIMENTS

Reference will be made to the preferred embodiments of the present invention with reference to the attached drawings. A detailed description of known functions and operations may be omitted to avoid obscuring the invention with unnecessary detail. Particular terms may be defined to describe the invention in the best manner. Accordingly, the meaning of specific terms or words used in the specification and the claims should not be limited to the literal or commonly employed sense, but should be construed in accordance with the spirit of the invention as described herein. The description of the various embodiments is to be construed as exemplary only and does not describe every possible instance of the invention. Therefore, it should be understood that various changes may be made and equivalents may be substituted for various elements of the invention.

Figure 1:
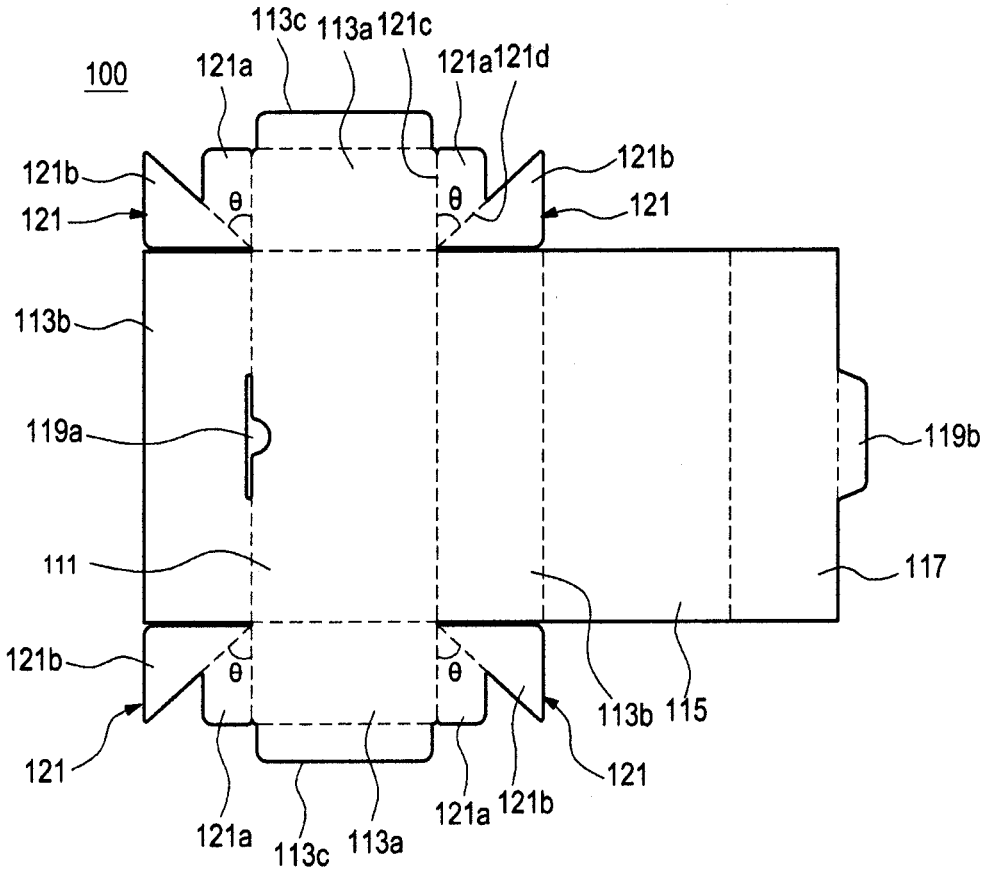
FIG. 1 is a plan view of a packing box according to an embodiment of the present invention.

Referring to FIG. 1, a packing box 100 according to an embodiment of the present invention includes a substantially square bottom plate 111, a pair of first side plates 113*a* and a pair of second side plates 113*b* along four edges of the bottom plate 111, and flaps 121 at both sides of each of the first side plates 113*a* facing each other. The first and second side plates 113*a* and 113*b* are provided in pairs. The first side plates 113*a* face each other, bendably with respect to the bottom plate 111 and the second side plates 113*b* also face each other, bendably with respect to the bottom plate 111. The flaps 121 connected to each of the first side plates 113*a* may be positioned so that when folded with respect to the first side plate 113*a*, they can face each other. In addition, each flap 121 includes a first flap portion 121*a* connected to a first side plate 113*a* and a second flap portion 121*b* that is connected to the first flap portion 121*a* and bendable with respect to the first flap portion 121*a*. As described in more detail below, during fabrication of packing box 100, the second flap portion 121*b* is to be affixed to one of the second side plates 113*b*.

The bottom plate 111, which is substantially square, forms the bottom surface of the packing box 100. The side plates 113*a* and 113*b* are provided along the four edges of the bottom plate 111 and when bent 90 degrees with respect to the bottom portion 111, form four sides of the packing box 100. The flaps 121 are provided at both sides of the pair of first side plates 113*a* facing each other. The flaps 121 are provided in pairs and each pair of flaps 121 are connected to one of the first side plates 113*a*. When the flaps 121 are bent with respect to the first side plate 113*a*, they face each other.

As stated before, each flap 121 is divided into first and second flap portions 121*a* and 121*b*. The first flap portion 121*a* is bendably connected to a first side plate 113*a* along a bending line 121*c*, and the second flap portion 121*b* is bendably connected to the first flap portion 121*a* along a bending line 121*d*. Bending line 121*d* is at a predetermined angle θ, preferably 45 degrees, with respect to the bending line 121*c*.

Figure 2:
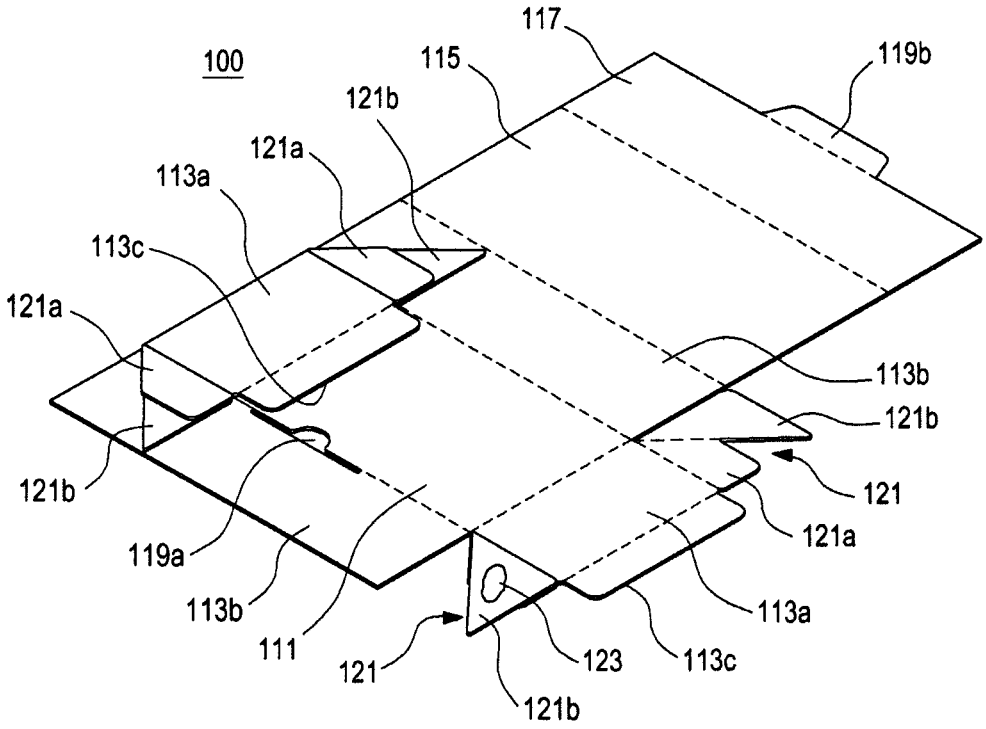
FIG. 2 is a perspective view of the packing box of FIG. 1 which is laid flat with a part folded.

Referring to FIG. 2, as shown by the position of the second flap 121*b* in the lower right corner of bottom plate 111 as compared with the position of the second flap 121*b* that opposes it on the opposite side of the first side plate 113*a*, all of the second flap portions 121*b* are to be folded along bending line 121*d* so as to lie flush against the first flap portion 121*a* to which it is bendably connected. Thereafter, each of the second flap portions 121*b* is fully folded so as to lie against an inner surface of one of the second side plates 113*b*. At this point, each of the second flap portions 121*b* is affixed to the inner surface of the one of the second side plates 113*b*. That is, upon fully folding each of the first side plates 113*a* to the bottom plate 111, the second flap portions 121*b* are affixed to the second side plates 113*b*. At the point in the fabrication process shown in FIG. 2, a second flap portion 121*b* is folded to a first flap portion 121*a* with one of the first side plates 113*a* unfolded from the bottom plate 111 and the other first side plate 113*a* is fully folded to the bottom plate 111. Thus, FIG. 2 illustrates a point in time in a process for bending a cut, machined base board of the packing box 100 into a hexahedron shape, in accordance with an embodiment of the invention.

In the course of finishing the fabrication of the base board of the packing box 100 so it can later be completed into a hexahedron shape, in accordance with an embodiment of the invention, with the second flap portions 121*b* fully folded to the first flap portions 121*a*, an adhesive 123 may be coated on one surface of each of the second flap portions 121*b*, specifically the surface of each of the second flap portions 121*b* which would be facing a second side plate 113*b* after being fully folded toward the bottom plate 111. After the adhesive 123 is coated on the folded second flap portions 121*b*, the first side plates 113*a* are folded toward the bottom plate 111, so as to face the bottom plate 111, as noted above. Once the adhesive 123 is cured, the second flap portions 121*b* are attached onto the inner surfaces of the second side plates 113*b*, facing the second side plates 113*b*. Thus, the second flap portions 121*b* are folded to the first flap portions 121*a*, the first side plates 113*a* are folded to the bottom plate 111, and the second flap portions 121*b* are attached to the inner surfaces of the second side plates 113*b*, facing the second side plates 113*b*. According to the fabrication process shown in FIG. 2, the fabrication of the packing box 100 is actually finished by affixing the second flap portions 121*b* to the second side plates 113*b*, with the first side plates 113*a* folded to the bottom plate 111.

Figure 3:
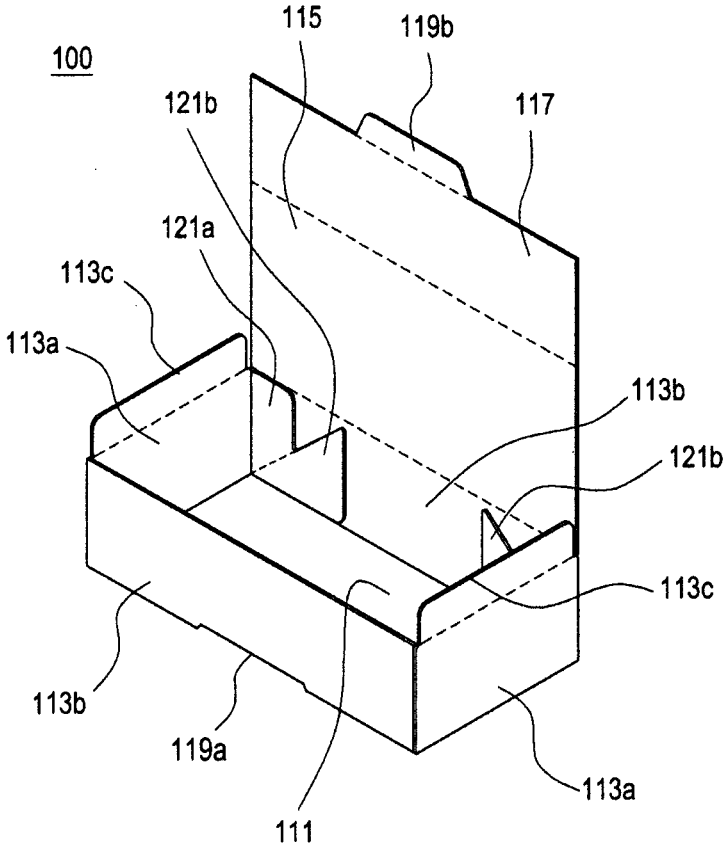
FIG. 3 is a perspective view of the packing box of FIG. 1 in a finished state.

Even though the packing box is completely fabricated, it is kept substantially flat, and not yet folded into the final form of a hexahedron shape, so as to facilitate shipping and storage of the packing box before use to pack contents therein. A user of the packing box 100, that is, a manufacturer of a product to be packed in the packing box 100, may readily (quickly and easily) shape the packing box 100 into a hexahedron shape simply by unfolding the first side plates 113*a* from the bottom portion 111, which can be a simple automated step in the process of wrapping a product, as illustrated in FIG. 3.

Since the bending lines 121*c* between the first side plates 113*a* and the first flap portions 121*a* and the bending lines

121*d* between the first flap portions 121*a* and the second flap portions 121*b* are inclined at 45 degrees with respect to each other, the first side plates 113*a* and the first flap portions 121*a* may be fully folded to the bottom plate 111 and the second side plates 113*b*, respectively, even while the second flap portions 121*b* are affixed to the second side plates 113*b*. Thereafter, when during final shaping of the packing box 100 into a hexahedron shape is desired, the first side plates 113*a* are merely opened (unfolded) so as to be 90 degrees from the bottom plate 111 and the second side plates 113*b* are also folded so as to be at 90 degrees with respect to the first side plates 113*a* and the bottom plate 111, thus providing a bottom and four raised sides for the packing box 100. As a finishing step to the first and second side plates 113*a* and 113*b* being unfolded in this manner from the bottom plate 111, the first flap portions 121*a* are brought into close contact with the inner surfaces of the second side plates 113*b* by bending along lines 121*d*, so as to face the second side plates 113*b*, as shown at the left rear inside surface of side plate 113*b* in FIG. 3.

Preferably, the packing box 100 further includes a cover 115 and an engaging portion 117 which engages the cover 115. The cover 115 is provided at one side of one of the second side plates 113*b* and folded, that is, bent, with respect to the second side plate 113*b*, thus facing the bottom plate 111. As the cover 115 is folded so as be positioned to face the bottom portion 111, the packing box 100 is finished so as to have a substantially full wrapping structure. The engaging portion 117 is used to prevent unintended opening of the cover 115. The engaging portion 117 is bendable with respect to the cover 115. The engaging portion 117 may be positioned so that it can surround the other second side plate 113*b*. Facing the other second side plate 113*b*, the engaging portion 117 is affixed. To affix the engaging portion 117 facing the other second side plate 113*b*, a fixture such as a magnetic body, a Velcro fastener, adhesive, tape, etc. may be used.

In an embodiment of the present invention, an engagement piece 119*b* and an engagement hole 119*a* are used as a fixture between the engagement portion 117 and the other second side plate 113*b*. The engagement piece 119*b* is provided on an edge of the engagement portion 117, bendably with respect to the engagement portion 117. The engagement hole 119*a* is elongated along a bending line between the other second side plate 113*b* and the bottom plate 111. The engagement hole 119*a* is partially extended into the bottom plate 111. The engagement hole 119*a* may be shaped to provide space for handling the engagement piece 119*b* inserted into the engagement hole 119*a*.

With the engagement portion 117 positioned to surround the other second side plate 113*b*, the engagement piece 119*b* is inserted into the engagement hole 119*a*, thus fastening the engagement portion 117. To minimize the space occupied by the engagement piece 119*b* inside the packing box 100, the engagement piece 119*b* is preferably brought into close contact with the bottom plate 111.

Meanwhile, dummy flaps 113*c* may be formed at at least the first side plates 113*a*, further the other second side plate 113*b* surrounded by the engagement portion 117. In the embodiment of the present invention, the dummy flaps 113*c* are formed only at the first side plates 113*a*, bendably with respect to the first side plates 113*a*, by way of example. When the packing box 100 is shaped into a hexahedron shape, the dummy flaps 113*c* are bent with respect to the first side plates 113*a*, over the open top of the packing box 100. Therefore, when the cover 115 faces the bottom plate 111, the dummy flaps 113*c* are covered by the cover 115.

The dummy flaps 113*c* can advantageously suppress deformation of the packing box 100. Referring to FIG. 3, the dummy flaps 113*c* are formed on upper ends of the first side plates 113*a*. Those skilled in the art will readily understand that with the dummy flaps 113*c* covered by the cover 115, the dummy flaps 113*c* are perpendicular to the first side plates 113*a*. Therefore, the dummy flaps 113*c* suppress inward or outward curved bending of the first side plates 113*a*.

The cover 115 also suppresses curved deformation of one of the second side plates 113*b*, similarly to the dummy flaps 113*c*. The other second side plate 113*b* is surrounded by the engagement portion 117, which makes the other second side plate 113*b* less vulnerable to deformation. Accordingly, there is no need for forming dummy flaps 113*c* at the second side plates 113*b*.

As described before, since each of the flaps 121 affixing the first side plate 113*a* to the second side plates 113*b* is divided into first and second flap portions 121*a* and 121*b* and the first and second flap portions 121*a* and 121*b* are bendable with respect to each other, the packing box 100 is kept flat during shipping and storage, thereby reducing logistics cost. In the process of wrapping an actual product, the packing box 100 can be readily shaped into a hexahedron shape.

Figure 4:
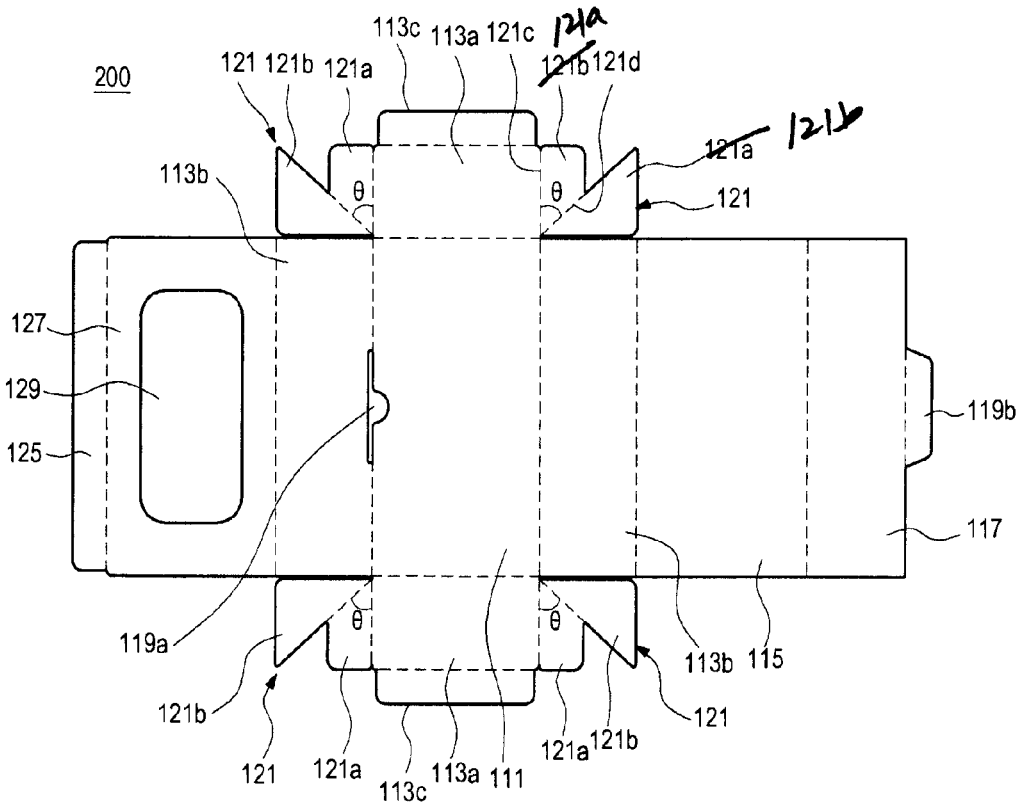
FIG. 4 is a plan view of a packing box according to another embodiment of the present invention.

FIG. 4 is a plan view of a packing box 200 according to another embodiment of the present invention. The packing box 200 differs from the packing box 100 in that the former further includes a second cover 127. Thus, like reference numerals, and in some cases no reference numerals are assigned to components that can be readily understood from the afore-described embodiment and a detailed description of the components will not be provided herein.

Referring to FIG. 4, the packing box 200 is provided with the cover 115 at one of the second side plates 113*b* and with the second cover 127 at the other second side plate 113*b*. With the cover 115 folded to face the bottom plate 111, the engaging portion 117 provided at the cover 115 is fixed surrounding the other second side plate 113*b*. The second cover 127 is also bent to face the bottom plate 111, intervening between the bottom plate 111 and the cover 115. A support 125 is provided to the second cover 127, affixed to the inner surface of the second side plate 113*b*, at a position near to a bending line between the cover 115 and the second side plate 113*b*. The support 125 is kept simply in contact with the inner surface of the second side plate 113*b*. Therefore, there is no need for gluing the support 125 or using a fixture such as a magnetic body for the support 125.

An opening 129 may be penetrated through the second cover 127. The second cover 127 may be useful in displaying a product wrapped in the packing box 200 in a store. That is, if only the cover 115 is opened, the second cover 127 may expose the product inside the packing box 200, maintaining the packing box 200 in a packed state. Therefore, various changes can be made to the shape of the opening 129 according to the shape of a product body that is to be positioned inside packing box 200.

In the above packing box, with the second flap portions 121*b* of the flaps kept affixed to the second side plates 113*b*, the first flap portions 121*a* may be freely bent within a predetermined angle range with respect to the second flap portions 121*b* in the same manner as described above for finishing the forming of the hexahedron shape of packing box 100. Therefore, while the bottom plate and the second side plates are kept flat, the fabrication portion of the packing box may be finished with the first flap portions folded to the second flap portions and the first side plates folded to the bottom plate. That is, since the packing box is kept substantially flat even though it is finished, the packing box advantageously provides reduced logistics cost involved in shipping and storage. In addition, when the folded first side plates are opened to 90 degrees with respect to the bottom plate, the first flap portions are brought into contact with the inner surfaces of the second side plates, thus shaping the packing box into a hexahedron shape, and as a consequence, the packing box 200 can be used immediately to pack a product. Thus, a cut, machined base board is fully fabricated by being bent so as to fold the second flap portions to the first flap portions and while in this state, then folding the first side plates to the bottom plate. That is, as the cut, machined base board is handled at all times in a flat state until it is ready to be used by attending to finishing it into the hexahedron shaped packing box, at which point automatic equipment can be readily used.

While the present invention has been particularly shown and described with reference to embodiments thereof, it will be understood by those of ordinary skill in the art that various changes in form and details may be made therein without departing from the spirit and scope of the present invention as defined by the following claims.

What is claimed is:

1. A packing box comprising:

a bottom plate;

a proximate end and a distal end first side plates arranged so as to extend in a substantially co-planar manner from opposed edges of the bottom plate, and adapted to be bent with respect to the bottom plate, so as to face each other upon final assembly of the packing box into a box shape;

a pair of second side plates arranged so as to extend in a substantially co-planar manner from opposed edges of the bottom plate, and adapted to be bent with respect to the bottom plate, so as to face each other upon final assembly of the packing box into a box shape; and a pair of flaps provided at both sides of each of the proximate end and distal end first side plates, arranged so as to extend in a substantially co-planar manner from the first side plates, and adapted to be bent with respect to the proximate end and distal end first side plates upon final assembly of the packing box into a box shape, a pair of reinforcing flaps provided on an edge that is perpendicular to both sides of each of the proximate end and distal end first side plates, arranged so as to extend in a substantially co-planar manner from the first side plates, and adapted to be bent with respect to the proximate end and distal end first side plates upon final assembly of the packing box into a box shape, wherein each of the flaps includes a first flap portion connected to the proximate end and distal end first side plates and a second flap portion connected to the first flap portion, bent with respect to the first flap portion and affixed to one of the second side plates such that the first flap portion forms a ledge along a top edge of each of the pair of second side plates substantially parallel to the bottom plate for supporting each end of the pair of reinforcing flaps and, where the first flap portion, the proximate end and the distal end first side plates, each of the pair of reinforcing flaps and the second flap portion after being affixed to one of the second side plates, are all substantially co-planar before being bent upon final assembly of the packing box into a box shape.

2. The packing box of claim 1, wherein the second flap portions are attached onto an inner surface of the one of the second side plates.

3. The packing box of claim 1, further comprising a cover provided at one of the second side plates, bent with respect to the one of the second side plates and facing the bottom plate.

4. The packing apparatus of claim 3, further comprising an engaging portion provided at the cover, for fixedly surrounding the other one of the second side plates.

5. The packing apparatus of claim 4, further comprising:

an engaging hole between the other one of the second side plates and the bottom plate; and an engaging piece provided at the engaging portion, wherein while the engaging portion surrounds the other one of the second side plates, the engaging piece is inserted to the engaging hole, thereby fixing the engaging portion.

6. The packing box of claim 5, wherein the engaging hole is a slot elongated along a bending line between the bottom plate and the other one of the second side plates.

7. The packing box of claim 3, further comprising a second cover provided at the other one of the second side plates, bent with respect to the other one of the second side plates and facing the bottom plate, wherein the second cover is interposed between the cover and the bottom plate.

8. The packing box of claim 7, further comprising an opening penetrating both surfaces of the second cover.

9. The packing box of claim 7, further comprising a support provided at the second cover, bent with respect to the second cover, wherein the support is fixed in contact with the inner surface of the one of the second side plates.

10. The packing box of claim 1, wherein bending lines provided between the first flap portions and the second flap portions are inclined at 45 degrees with respect to bending lines provided between the first side plates and the first flap portions.

11. A method for forming a packing box comprising:

providing a substantially flat bottom plate;

providing a proximate end and a distal end first side plates arranged so as to extend in a substantially co-planar manner from opposed edges of the bottom plate, and adapted to be bent with respect to the bottom plate, so as to face each other upon final assembly of the packing box into a box shape;

providing a pair of second side plates arranged so as to extend in a substantially co-planar manner from opposed edges of the bottom plate, and adapted to be bent with respect to the bottom plate, so as to face each other upon final assembly of the packing box into a box shape;

providing a pair of reinforcing flaps provided on an edge that is perpendicular to both sides of each of the proximate end and distal end first side plates, arranged so as to extend in a substantially co-planar manner from the first side plates, and adapted to be bent with respect to the proximate end and distal end first side plates upon final assembly of the packing box into a box shape, providing a pair of flaps at both sides of each of the proximate end and the distal end first side plates, arranged so as to extend in a substantially co-planar manner from each of the proximate end and the distal end first side plates, and adapted to be bent with respect to each of the proximate end and the distal end first side plates upon final assembly of the packing box into a box shape, each of the pair of flaps including a first flap portion and a second flap portion, wherein the first flap portion and the second flap portion of each of the pair of flags are connected and wherein the first flap portion of one of the pair of flaps is connected to the proximate end first side plate and another one of the pair of flaps is connected to the distal end first side plate, and wherein each of the second flap portion is affixed to one of the pair of second side plates such that the first flap portion forms a ledge along a top edge of each of the pair of second side plates substantially parallel to the bottom plate for supporting each end of the pair of reinforcing flaps and, bending each of the pair of reinforcing flaps from the proximate end and distal end first side plates to extend in a substantially co-planar manner to the bottom plate, bending each of the second flap portion with respect to each of the first flap portion, and affixing each of the bent second flap portion to one of the second side plates, where each of the first flap portion, the first side plates and the second flap portion after being affixed to one of the second side plates, are all substantially co-planar before being bent upon final assembly of the packing box into a box shape.

12. The method of claim 11, further comprising bending the proximate end and the distal end first side plates with respect to the bottom plate, so that the proximate end and distal end first side plates face each other.

13. The method of claim 12, further comprising bending the second side plates with respect to the bottom plate, so that the second side plates face each other.

14. The method of claim 13, further comprising providing bending lines between the first flap portions and the second flap portions that are inclined at 45 degrees with respect to bending lines provided between the proximate end and a distal end first side plates and the first flap portions.

15. The method of claim 14, where bending with respect to the bottom plate of each of the proximate end and a distal end first side plates having the pair of flaps at both sides thereof, causes bending of each of the first flap portion so it moves from being substantially co-planar with each one of the proximate end and a distal end first side plates to being substantially co-planar with each of the second side plates.

* * * * *

UNITED STATES PATENT AND TRADEMARK OFFICE

CERTIFICATE OF CORRECTION

PATENT NO. : 8,783,549 B2
APPLICATION NO. : 13/672030
DATED : July 22, 2014
INVENTOR(S) : Kyoung-Hwan Jo It is certified that error appears in the above-identified patent and that said Letters Patent is hereby corrected as shown below:

In the Claims:

Column 8, Claim 11, Line 63 should read as follows:
--...pair of flaps are...--

Column 10, Claim 15, Line 14 should read as follows:
--...each one of the...--

Signed and Sealed this
Seventh Day of October, 2014

Michelle K. Lee

Michelle K. Lee
*Deputy Director of the United States Patent and Trademark Office*